US010916865B2

(12) United States Patent
Eriksen

(10) Patent No.: US 10,916,865 B2
(45) Date of Patent: Feb. 9, 2021

(54) COAXIAL CABLE CONNECTOR

(71) Applicant: PPC BROADBAND, INC., East Syracuse, NY (US)

(72) Inventor: Kim Eriksen, Tappernøje (DK)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/515,006

(22) Filed: Jul. 17, 2019

(65) Prior Publication Data

US 2020/0028284 A1 Jan. 23, 2020

Related U.S. Application Data

(60) Provisional application No. 62/699,051, filed on Jul. 17, 2018.

(51) Int. Cl.
*H01R 9/05* (2006.01)
*H01R 103/00* (2006.01)

(52) U.S. Cl.
CPC ..... *H01R 9/0524* (2013.01); *H01R 2103/00* (2013.01)

(58) Field of Classification Search
CPC ..... H01R 9/05; H01R 9/0503; H01R 9/0527; H01R 9/0524; H01R 2103/00
USPC ..... 439/578, 582
See application file for complete search history.

(56) References Cited

U.S. PATENT DOCUMENTS 3,332,052 A 7/1967 Rusinyak
7,635,283 B1 12/2009 Islam
7,674,132 B1 * 3/2010 Chen ..... H01R 9/0524 439/578
7,892,024 B1 * 2/2011 Chen ..... H01R 13/6583 439/578
8,192,237 B2 * 6/2012 Purdy ..... H01R 24/40
8,556,654 B2 * 10/2013 Chastain ..... H01R 9/0527 439/578
9,004,931 B2 * 4/2015 Montena ..... H01R 9/0524 439/253
9,190,744 B2 * 11/2015 Burris ..... H01R 13/6581
9,531,090 B2 * 12/2016 Burris ..... H01R 9/053
(Continued)

OTHER PUBLICATIONS

Oct. 18, 2019 International Search Report and Written Opinion issued in PCT/US19/42303.

*Primary Examiner* — Gary F Paumen
(74) *Attorney, Agent, or Firm* — MH2 Technology Law Group LLP

(57) ABSTRACT

A connector is configured to terminate an end of a coaxial cable. The connector includes a body, a nut, an outer conductor engager, and a grounding member. The body has a cable receiving end configured to receive the end of the coaxial cable, and the nut is configured to be coupled with and to rotate relative to the body. The outer conductor engager is configured to receive a conductive layer of end of the coaxial cable, and the grounding member is configured to couple the body, the nut, and the outer conductor engager in an assembled configuration. A first end of the grounding member is configured to extend grounding of the coaxial cable from the outer conductor engager to the nut, and a second end of the grounding member is configured to grip an outer protective jacket of the coaxial cable to prevent removal of the coaxial cable from the connector.

20 Claims, 6 Drawing Sheets

(56) References Cited

U.S. PATENT DOCUMENTS

| | | | | |
|---|---|---|---|---|
| 2010/0297875 | A1* | 11/2010 | Purdy | H01R 24/38 439/578 |
| 2012/0094530 | A1* | 4/2012 | Montena | H01R 9/0527 439/578 |
| 2012/0129387 | A1* | 5/2012 | Holland | H01R 13/622 439/578 |
| 2012/0135639 | A1 | 5/2012 | Paglia et al. | |

* cited by examiner

COAXIAL CABLE CONNECTOR

CROSS-REFERENCE TO RELATED APPLICATION

This nonprovisional application claims the benefit of U.S. Provisional Application No. 62/699,051, filed on Jul. 17, 2018. The disclosure of the prior application is hereby incorporated by reference herein in its entirety.

TECHNICAL FIELD

The present disclosure relates generally to connectors for terminating coaxial cable. More particularly, the present disclosure relates to a coaxial cable connector that does not require a compression tool for installation on a prepared end of a coaxial cable.

BACKGROUND

It has long been known to use connectors to terminate coaxial cable so as to connect a cable to various electronic devices such as televisions, radios and the like. Conventional coaxial cables typically include a center conductor surrounded by an insulator. A braided or foil conductive shield is disposed over the insulator. An outer insulative jacket surrounds the shield. In order to prepare the coaxial cable for termination, the outer jacket is stripped back exposing an extent of the conductive shield, which may or may not be folded back over the jacket. A portion of the insulator extends outwardly from the jacket and an extent of the center conductor extends outwardly from insulator. Such a prepared cable may be terminated in a conventional coaxial connector.

Coaxial connectors of this conventional type include a connector body having an inner cylindrical post which is inserted between the insulator and the conductive shield. A locking sleeve is provided to secure the cable within the body of the coaxial connector. The locking sleeve, which is typically formed of a resilient plastic, is securable to the connector body to secure the coaxial connector thereto. Conventional connectors of this type require a compression tool for installation. Thus, installers need to carry these compression tools into the field and, if the compression tool breaks or is misplaced, the conventional connectors cannot be assembled to a coaxial cable. Such connectors also typically have an elongated profile.

Therefore, it may be desirable to provide a coaxial connector that can be assembled to a coaxial cable without the use of a compression tool. Further, it may be desirable to provide a coaxial connector having a shorter length than conventional coaxial connectors.

SUMMARY

According to some aspects of the disclosure a coaxial cable connector is provided for terminating a coaxial cable.

In accordance with some aspects, a connector is configured to terminate an end of a coaxial cable. The connector includes a body, a nut, an outer conductor engager, and a grounding member. The body has a cable receiving end configured to receive the end of the coaxial cable, and the nut is configured to be coupled with and to rotate relative to the body. The outer conductor engager is configured to receive a conductive layer of end of the coaxial cable, and the grounding member is configured to couple the body, the nut, and the outer conductor engager in an assembled configuration. A first end of the grounding member is configured to extend grounding of the coaxial cable from the outer conductor engager to the nut, and a second end of the grounding member is configured to grip an outer protective jacket of the coaxial cable to prevent removal of the coaxial cable from the connector.

In some aspects, the first end of the grounding member includes grounding fingers configured to engage the nut.

In some aspects, the first end of the grounding member includes retaining fingers configured to engage the outer conductor engager.

In some aspects, the second end of the grounding member includes resilient fingers configured to engage the protective jacket.

In some aspects, the second end of the grounding member is coupled with the body via a press fit or interference fit.

In some aspects, the outer conductor engager includes a flange configured to engage an internal lip of the nut to maintain the connector in the assembled configuration In some aspects, the connector is configured to terminate a prepared end of the coaxial cable without the use of a compression tool.

The foregoing and other features of construction and operation of the invention will be more readily understood and fully appreciated from the following detailed disclosure, taken in conjunction with accompanying drawings. Throughout the description, like reference numerals will refer to like parts in the various embodiments and drawing figures.

DETAILED DESCRIPTION OF EMBODIMENTS

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a," "an," and "the" include plural referents, unless the context clearly dictates otherwise.

Figure 1:
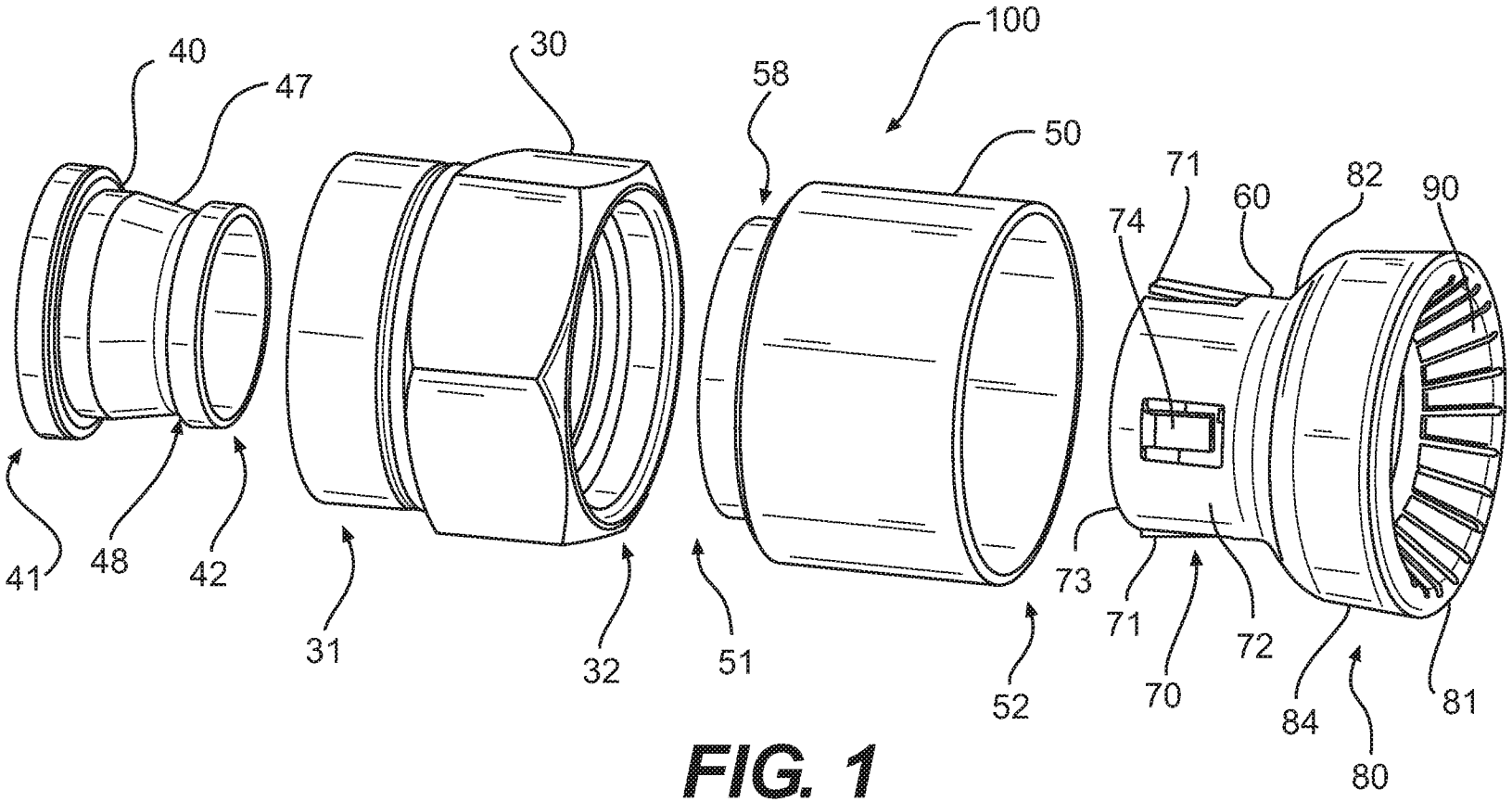
FIG. 1 is an exploded perspective view of an exemplary coaxial connector in accordance with various aspects of the present disclosure.
Figure 2:
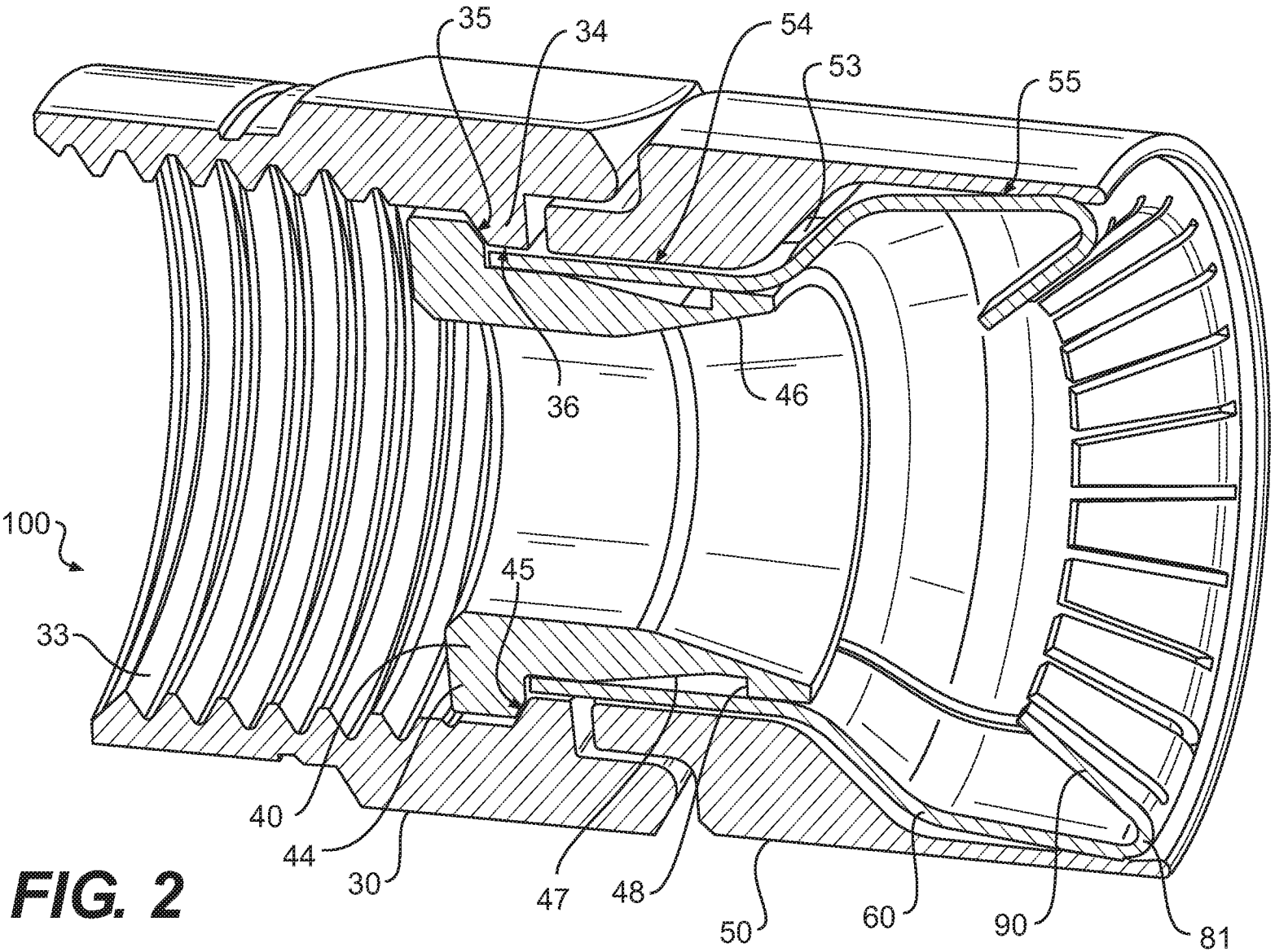
FIG. 2 is a cross-sectional perspective view of the exemplary coaxial connector of FIG. 1.
Figure 3:
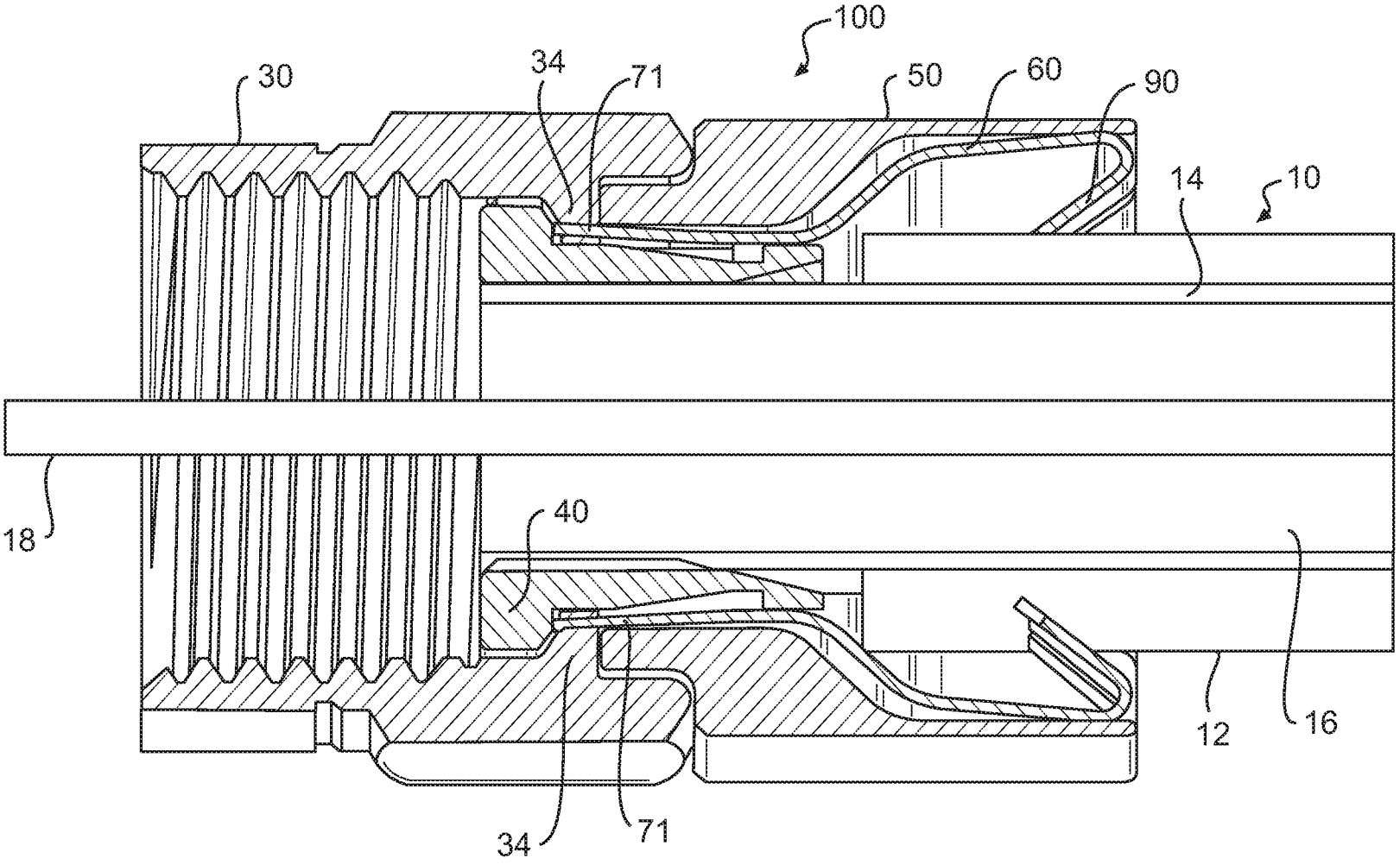
FIG. 3 is a side view along a first cross-section of the exemplary coaxial connector of FIG. 1 coupled with a coaxial cable.
Figure 4:
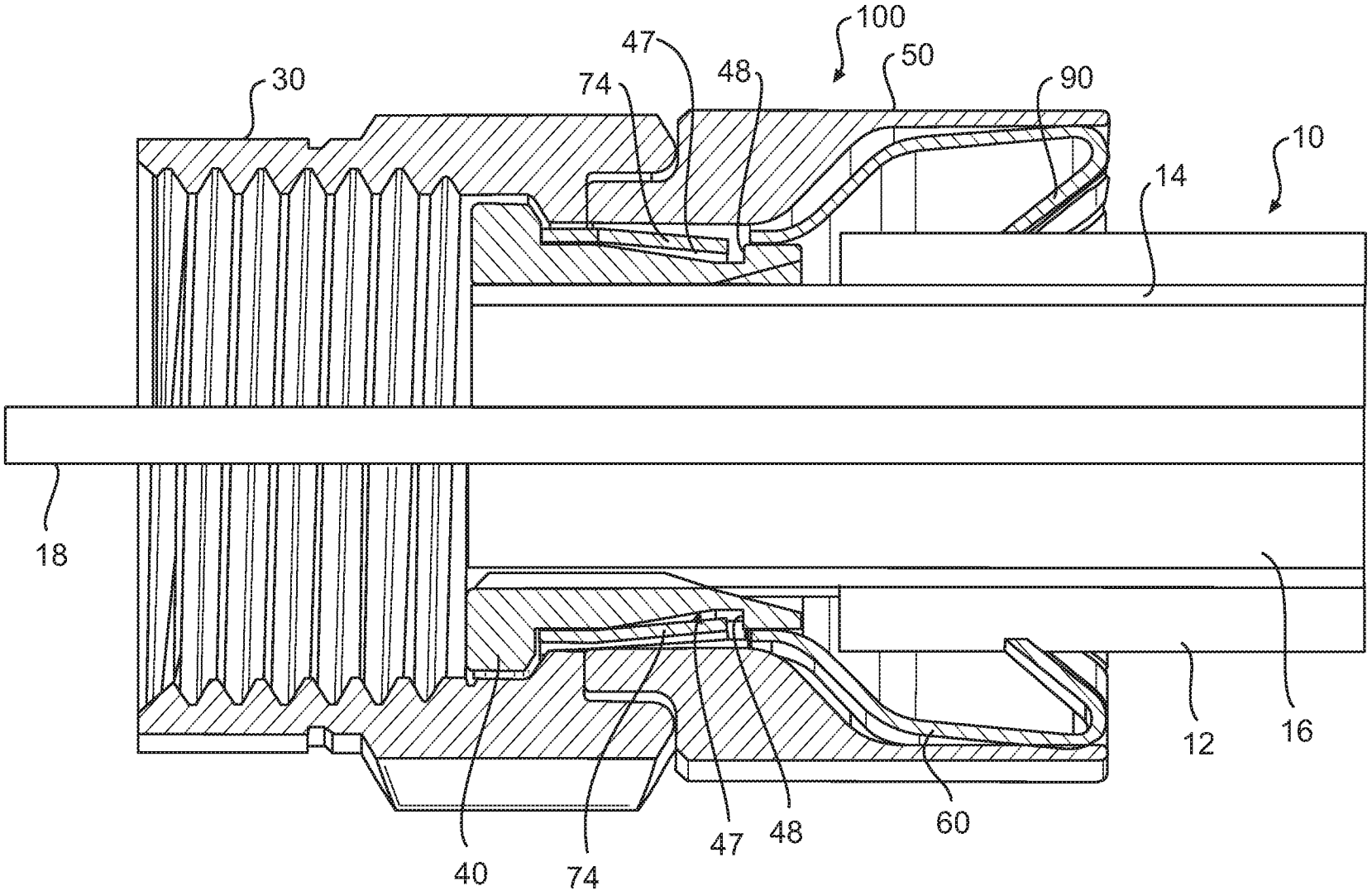
FIG. 4 is a side view along a second cross-section of the exemplary coaxial connector of FIG. 1 coupled with a coaxial cable.
Figure 6:
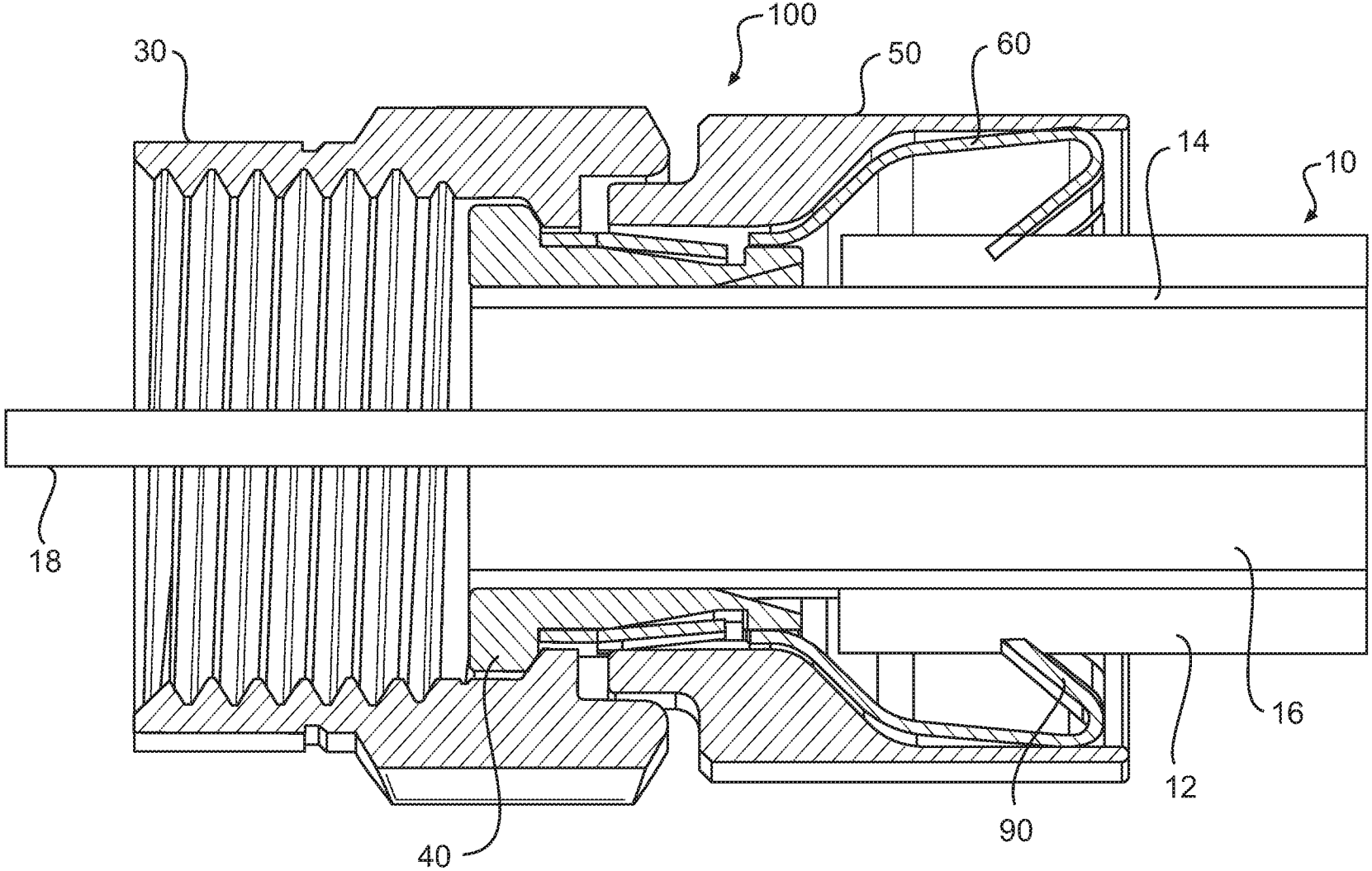
FIG. 6 is a side view along the second cross-section of the exemplary coaxial connector of FIG. 1 during termination of a coaxial cable.

Referring to the drawings, FIGS. 1 and 2 depict an embodiment of a coaxial cable connector 100 according to various aspects of the disclosure. As shown in FIGS. 3, 4, and 6, the coaxial cable connector 100 may be operably affixed, or otherwise functionally attached, to a coaxial cable 10 having a protective outer jacket 12, a conductive grounding shield 14, an interior dielectric 16 and a center conductor 18. The connector 100 is configured to be coupled with a coaxial cable interface port (not shown). An embodiment of a coaxial cable connector 100 includes a nut 30, an outer conductor engager 40, a connector body 50, and a grounding member 60 formed of conductive material.

The coaxial cable 10 may be prepared as shown in FIGS. 3 and 4 by removing the protective outer jacket 12 to expose a portion of the conductive grounding shield 14, which surrounds the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer.

Those skilled in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

The nut 30 of embodiments of the coaxial cable connector 100 may be a threaded nut having a first forward end 31 and opposing second rearward end 32. The nut 30 may comprise internal threading 33 extending axially from the edge of first forward end 31 a distance sufficient to provide operably effective threadable contact with the external threads of a standard coaxial cable interface port. The threaded nut 30 includes an internal lip 34, such as an annular protrusion, located between the first forward end 31 and the second rearward end 32 of the nut. The internal lip 34 includes a surface 35 facing the first forward end 31 of the nut 30 and a radially inward facing surface 36. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100.

In some aspects, the second rearward end 32 of the nut 30 may extend an axial distance to reside radially extent, or otherwise partially surround, a portion of the connector body 50, although the extended portion of the nut 30 need not contact the connector body 50. Those in the art should appreciate that the nut need not be threaded. Moreover, the nut 30 may comprise a coupler commonly used in connecting RCA-type, or BNC-type connectors, or other common coaxial cable connectors having standard coupler interfaces. The nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port when the connector 100 is advanced onto the interface port. In addition, the nut 30 may be formed of both conductive and non-conductive materials. For example the external surface of the nut 30 may be formed of a polymer, while the remainder of the nut 30 may be comprised of a metal or other conductive material. The nut 30 may be formed of metals or polymers or other materials that would facilitate a rigidly formed nut body. Manufacture of the nut 30 may include casting, extruding, cutting, knurling, turning, tapping, drilling, injection molding, blow molding, combinations thereof, or other fabrication methods that may provide efficient production of the component. The forward facing surface 35 of the lip 34 of the nut 30 faces a flange 44 of the outer conductor engager 40 when operably assembled in the connector 100, so as to allow the nut to rotate with respect to the other component elements, such as the outer conductor engager 40 and the connector body 50, of the connector 100.

Referring again to FIGS. 1 and 2, in an embodiment of the connector 100, the outer conductor engager 40 comprises a first forward end 41 and an opposing second rearward end 42. Furthermore, the outer conductor engager 40 may comprise the flange 44, such as an externally extending annular protrusion, located at the first end 41 of the outer conductor engager 40. The flange 44 includes a rearward facing surface 45 that faces the forward facing surface 35 of the nut 30, when operably assembled in a coaxial cable connector 100, so as to allow the nut to rotate with respect to the other component elements, such as the outer conductor engager 40 and the connector body 50, of the connector 100. The rearward facing surface 45 of flange 44 may be a tapered surface facing the second rearward end 42 of the outer conductor engager 40. The second rearward end 42 of the outer conductor engager 40 includes a tapered inner surface 46 that tapers in a direction from the second rearward end 42 toward the first forward end 41. The tapered inner surface 46 is configured to facilitate insertion of the conductive grounding shield 14, the interior dielectric 16, and the center conductor 18 of the coaxial cable 10 into the outer conductor engager 40.

According to embodiments of the connector 100, the connector body 50 may comprise a first end 51 and opposing second end 52. The connector body 50 may include an outer annular recess 58 located proximate or near the first end 51 of the connector body 50 and configured to receive the second rearward end 32 of the nut 30. The second end 52 of the connector body 50 is a cable receiving end. The connector body 50 includes a tapered inner surface 53 between the first end 51 and the second end 52 configured such that the first end 51 defines a through bore 54 having a diameter that is smaller than a diameter of a through bore 55 defined by the second end 52.

With further reference to FIGS. 1-4, embodiments of the coaxial cable connector 100 include a grounding member 60. The grounding member 60 includes a forward portion 70 and a rearward portion 80. The forward portion 70 is between the outer conductor engager 40 and the body 50 in the radial direction, and the rearward portion 80 extends rearward from the second rearward end 42 of the outer conductor engager 40. The forward portion 70 includes a small diameter portion 72, and the rearward portion 80 includes a first tapered portion 82 extending rearward from the small diameter portion 72 and a second tapered portion 84 extending rearward from the first tapered portion 82. The first and second tapered portions 82, 84 taper from the rearward end of the connector 100 toward the forward end of the connector. The first tapered portion 82 tapers at a greater angle than the second tapered portion 84. In some embodiments, at least a portion of the second tapered portion 84 that is at a rearward end 81 of the rearward portion 80 has an outside diameter that is greater than an inside diameter of the second end 52 of the connector body 50 when in a rest configuration prior to be assembled with the connector body 50.

The grounding member 60 includes a plurality of resilient fingers 90 that extend radially inward and axially forward from the rearward end 81 of the rearward portion 80. The plurality of resilient fingers 90 define an inner diameter that is smaller than an outer diameter of the protective outer jacket 12 of the coaxial cable 10. In some embodiments, the grounding member 60 includes a pair of grounding fingers 71 and a pair of retaining fingers 74 at the forward portion 70. The pair of grounding fingers 71 extend radially outward and axially forward at a forward end 73 of the forward portion 70. An outer diameter of the pair of grounding fingers 71 in a relaxed configuration is greater than an inner diameter of the radially inward facing surface 36 of the nut 30 such that when the grounding fingers 71 are received in the radially inward facing surface 36 of the nut 30, the radially inward facing surface 36 urges the grounding fingers 71 radially inward such that the grounding fingers 71 maintain contact with the radially inward facing surface 36 of the nut 30 when the connector 100 is assembled. The pair of retaining fingers 74 are spaced rearward from the forward end 73 and extend radially inward and axially rearward from the forward end 73 of the forward portion 70. The outer conductor engager 40 includes an outer surface feature 47, such as a groove, that is configured to receive the pair of retaining fingers 74. The surface feature 47 defines a forward facing shoulder 48 that may engage the pair of retaining fingers 74 of the grounding member 60 to limit relative axial movement between the outer conductor engager 40 and the grounding member 60.

Figure 5:
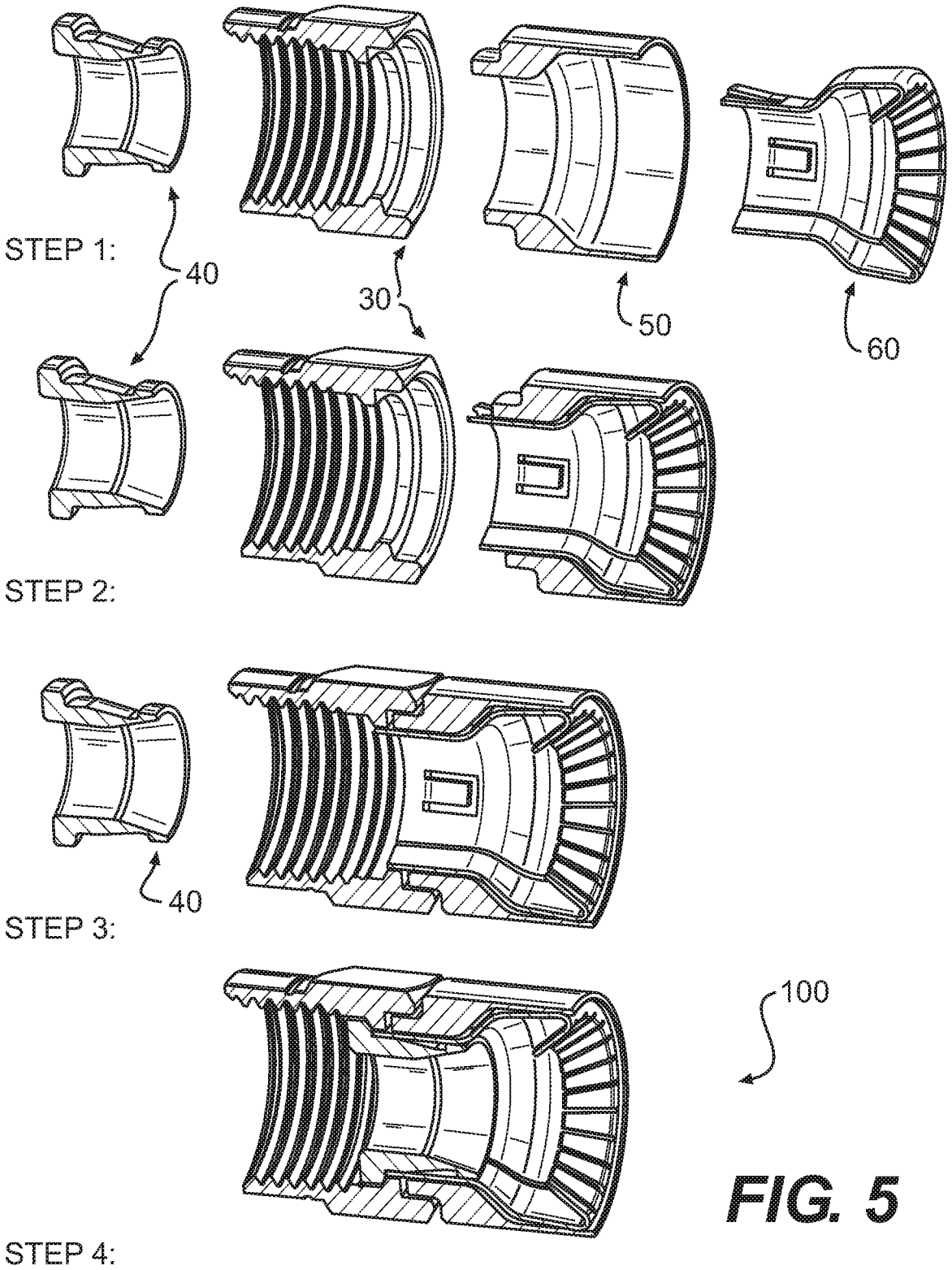
FIG. 5 illustrates a series of perspective cross-sectional views illustrating assembly of the exemplary coaxial connector of FIG. 1.

Referring now to FIG. 5, steps for assembly of the connector 100 are illustrated. As shown in Step 1, the connector 100 includes the nut 30, the outer conductor engager 40, the connector body 50, and the grounding member 60 as separate structural elements. In Step 2, the forward portion 70 of the grounding member 60 is inserted into the second end 52 of the connector body 50. The connector 100 may rely on press-fitting and friction-fitting between the grounding member 60 and the connector body 50 to help retain the grounding member 60 within the connector body 50.

In Step 3, the first end 51 of the connector body 50 and the forward portion 70 of the grounding member 60 are inserted into second rearward end 32 of the nut 30 such that the grounding fingers 71 engage the radially inward facing surface 36 of the internal lip 34 of the nut 30 and are urged radially inward by the internal lip 34 so as to maintain physical and electrical contact between the grounding member 60 and the nut 30. The urging of the grounding fingers 71 by the internal lip 34 allows the grounding member 60 to make physical and electrical contact with the outer conductor engager 40, when the coaxial cable connector 100 is operably assembled, and helps facilitate the extension of electrical grounding through the outer conductor engager 40.

In Step 4, the second rearward end 42 of the outer conductor engager 40 is inserted into the first forward end 31 of the nut 30. The outer conductor engager 40 is moved in a rearward direction relative to the nut 30 until the shoulder 48 moves past the retaining fingers 74. The retaining fingers 74 are configured to be urged radially outward as the second rearward end 42 of the outer conductor engager 40 moves past them, and the retaining fingers 74 are configured to return to their original orientation extending radially inward and axial rearward so as to be accommodated in the outer surface feature 47 of the outer conductor engager 40. The retaining fingers 74 and the shoulder 48 of the outer conductor engager 40 cooperate to maintain the connector 100 in the assembled configuration of Step 4.

Referring now to FIG. 6, a prepared end of a coaxial cable 10 is terminated by the assembled connector 100. The coaxial cable 10 is inserted into the second end 52 of the connector body 50 and through the opening defined by the resilient fingers 90 of the grounding member 60. As the coaxial cable 10 is pushed forward relative to the outer conductor engager 40, the tapered inner surface facilitates insertion of the conductive grounding shield 14, the interior dielectric 16, and the center conductor 18 of the coaxial cable 10 into the outer conductor engager 40 such that substantial physical and/or electrical contact with the shield 14 may be accomplished thereby facilitating grounding through the outer conductor engager 40.

As shown in FIG. 6, the coaxial cable 10 can be inserted in a forward direction to a position that moves the grounding member 60 and the outer conductor engager 40 forwardly relative to the connector body 50, which allows the nut 30 to move forwardly away from the connector body 50. The coaxial cable 10 can then be pulled in a rearward direction such that the resilient fingers 90 of the grounding member 60 are configured to grip, or bite into, the protective outer jacket 12 of the coaxial cable 10. The rearward pulling of the coaxial cable 10 also moves the grounding member 60 and outer conductor engager 40 rearward relative to the connector body 50, which in turn moves the nut 30 rearward toward the connector body 50 to the configuration illustrated in FIGS. 3 and 4.

In addition, as best depicted in FIG. 5, various embodiments of the grounding member 60 may include a through-slit 66 that extends through the entire grounding member 60. The grounding member 60 having a through-slit 66 may be formed from a sheet of material that may be stamped and then bent into an operable shape, which allows the grounding member 60 to function as it was intended.

Additional embodiments include any one of the embodiments described above, where one or more of its components, functionalities or structures is interchanged with, replaced by or augmented by one or more of the components, functionalities, or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial cable connector configured to terminate an end of a coaxial cable, the connector comprising:

a body having a cable receiving end configured to receive the end of the coaxial cable;

a nut configured to be coupled with and to rotate relative to the body;

an outer conductor engager configured to receive a conductive layer of the end of the coaxial cable; and a grounding member configured to couple the body, the nut, and the outer conductor engager in an assembled configuration without the use of a compression tool, wherein a first end of the grounding member includes grounding fingers configured to engage the nut and retaining fingers configured to engage the outer conductor engager so as to extend grounding of the coaxial cable from the outer conductor engager to the nut, wherein a second end of the grounding member is coupled with the body via a press fit or interference fit, wherein the second end of the grounding member includes resilient fingers configured to engage an outer protective jacket of the coaxial cable and grip the outer protective jacket to prevent removal of the coaxial cable from the connector, and wherein the outer conductor engager includes a flange configured to engage an internal lip of the nut to maintain the connector in the assembled configuration.

2. The connector of claim 1, wherein the plurality of resilient fingers define an inner diameter that is smaller than an outer diameter of the outer protective outer jacket of the coaxial cable.

3. The connector of claim 1, wherein an outer diameter of the grounding fingers in a relaxed configuration is greater than an inner diameter of a radially inward facing surface of the internal lip of the nut such that when the grounding fingers are received in the radially inward facing surface, the radially inward facing surface urges the grounding fingers radially inward such that the grounding fingers maintain contact with the radially inward facing surface of the nut when the connector is assembled.

4. The connector of claim 1, wherein the retaining fingers extend radially inward and axially rearward from the forward end of the forward portion, and the outer conductor engager includes an outer surface feature configured to receive the retaining fingers to limit relative axial movement between the outer conductor engager and the grounding member.

5. A coaxial cable connector configured to terminate an end of a coaxial cable, the connector comprising:

a body having a cable receiving end configured to receive the end of the coaxial cable;

a nut configured to be coupled with and to rotate relative to the body;

an outer conductor engager configured to receive a conductive layer of the end of the coaxial cable; and a grounding member configured to couple the body, the nut, and the outer conductor engager in an assembled configuration without the use of a compression tool, wherein a first end of the grounding member is configured to extend grounding of the coaxial cable from the outer conductor engager to the nut, wherein a second end of the grounding member is configured to grip an outer protective jacket of the coaxial cable to prevent removal of the coaxial cable from the connector, wherein the first end of the grounding member includes grounding fingers configured to engage the nut and retaining fingers configured to engage the outer conductor engager, wherein the second end of the grounding member includes resilient fingers configured to engage the protective jacket and is coupled with the body via a press fit or interference fit, and wherein the outer conductor engager includes a flange configured to engage an internal lip of the nut to maintain the connector in the assembled configuration.

6. The connector of claim 5, wherein the plurality of resilient fingers define an inner diameter that is smaller than an outer diameter of the outer protective outer jacket of the coaxial cable.

7. The connector of claim 5, wherein an outer diameter of the grounding fingers in a relaxed configuration is greater than an inner diameter of a radially inward facing surface of the internal lip of the nut such that when the grounding fingers are received in the radially inward facing surface, the radially inward facing surface urges the grounding fingers radially inward such that the grounding fingers maintain contact with the radially inward facing surface of the nut when the connector is assembled.

8. The connector of claim 5, wherein the retaining fingers extend radially inward and axially rearward from the forward end of the forward portion, and the outer conductor engager includes an outer surface feature configured to receive the retaining fingers to limit relative axial movement between the outer conductor engager and the grounding member.

9. A connector configured to terminate an end of a coaxial cable, the connector comprising:

a body having a cable receiving end configured to receive the end of the coaxial cable;

a nut configured to be coupled with and to rotate relative to the body;

an outer conductor engager configured to receive a conductive layer of the end of the coaxial cable; and a grounding member slidingly received on the outer conductor engager, the grounding member being configured to couple the body, the nut, and the outer conductor engager in an assembled configuration, wherein a first end of the grounding member is configured to extend grounding of the coaxial cable from the outer conductor engager to the nut, and wherein a second end of the grounding member is configured to grip an outer protective jacket of the coaxial cable to prevent removal of the coaxial cable from the connector.

10. The connector of claim 9, wherein the first end of the grounding member includes grounding fingers configured to engage the nut.

11. The connector of claim 9, wherein the first end of the grounding member includes retaining fingers configured to engage the outer conductor engager.

12. The connector of claim 9, wherein the second end of the grounding member includes resilient fingers configured to engage the protective jacket.

13. The connector of claim 9, wherein the second end of the grounding member is coupled with the body via a press fit or interference fit.

14. The connector of claim 9, wherein the outer conductor engager includes a flange configured to engage an internal lip of the nut to maintain the connector in the assembled configuration.

15. The connector of claim 9, wherein the grounding member is configured to couple the body, the nut, and the outer conductor engager in the assembled configuration without the use of a compression tool.

16. The connector of claim 12, wherein the resilient fingers define an inner diameter that is smaller than an outer diameter of the protective outer jacket of the coaxial cable.

17. The connector of claim 14, wherein the first end of the grounding member includes grounding fingers configured to engage the nut.

18. The connector of claim 17, wherein an outer diameter of the grounding fingers in a relaxed configuration is greater than an inner diameter of a radially inward facing surface of the internal lip of the nut such that when the grounding fingers are received in the radially inward facing surface, the radially inward facing surface urges the grounding fingers radially inward such that the grounding fingers maintain contact with the radially inward facing surface of the nut when the connector is assembled.

19. The connector of claim 11, wherein the retaining fingers extend radially inward and axially rearward from the forward end of the forward portion, and the outer conductor engager includes an outer surface feature configured to receive the retaining fingers to limit relative axial movement between the outer conductor engager and the grounding member.

20. The connector of claim 9, wherein the outer conductor engager and the grounding member are configured to limit relative axial movement between the outer conductor engager and the grounding member.

* * * * *